US007411603B2

(12) United States Patent
Rehmann

(10) Patent No.: US 7,411,603 B2
(45) Date of Patent: Aug. 12, 2008

(54) LIGHT GUIDE

(75) Inventor: David A. Rehmann, Vancouver, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 172 days.

(21) Appl. No.: 11/092,321

(22) Filed: Mar. 29, 2005

(65) Prior Publication Data

US 2006/0227200 A1 Oct. 12, 2006

(51) Int. Cl.
*B41J 2/435* (2006.01)

(52) U.S. Cl. ..... 347/264

(58) Field of Classification Search ..... 347/111, 347/116, 16, 234, 264; 250/560
See application file for complete search history.

(56) References Cited

U.S. PATENT DOCUMENTS 4,088,265 A 5/1978 Garczynski
4,160,913 A 7/1979 Brenholdt
4,186,309 A * 1/1980 Gnuechtel ..... 250/559.43
4,243,891 A 1/1981 Dobler et al.
4,289,406 A * 9/1981 Maddox ..... 356/429
4,295,040 A 10/1981 Berthier
4,480,546 A 11/1984 Uno et al.
4,559,451 A * 12/1985 Curl ..... 250/559.36
4,609,815 A 9/1986 Hishinuma et al.
4,711,579 A 12/1987 Wilkinson
4,737,649 A 4/1988 Naruse
4,786,921 A * 11/1988 Suzuki ..... 347/111
5,006,719 A * 4/1991 Blaser ..... 250/559.36
5,395,027 A * 3/1995 Erhardt ..... 226/24
5,745,817 A * 4/1998 Yamazaki et al. ..... 399/16
5,831,741 A 11/1998 Milillo
6,031,561 A * 2/2000 Narayan et al. ..... 347/255
6,104,037 A 8/2000 Harris
6,717,756 B2 * 4/2004 Berman et al. ..... 359/833
6,744,050 B1 6/2004 Hornung et al.
6,774,893 B2 * 8/2004 Debiez et al. ..... 345/207
6,812,997 B2 11/2004 Kaltenbach et al.
6,982,813 B2 * 1/2006 Hirata et al. ..... 358/1.9

FOREIGN PATENT DOCUMENTS

JP 02020370 A * 1/1990
JP 02022081 A * 1/1990
JP 10307341 11/1998
JP 11115271 A * 4/1999
JP 2002214717 7/2002
JP 2003015232 1/2003

OTHER PUBLICATIONS

Wikipedia Online Encyclopedia (http://en.wikipedia.org/wiki/Light_bulb).*
Wikipedia Online Encyclopedia (http://en.wikipedia.org/wiki/Light-emitting_diode).*

* cited by examiner

*Primary Examiner*—Hai C Pham
*Assistant Examiner*—Kainoa B Wright

(57) ABSTRACT

In embodiments, light from a light guide is used to generate a signal.

18 Claims, 3 Drawing Sheets

LIGHT GUIDE

BACKGROUND

One type of print media often used in image forming systems is print media having preformed holes therein. In some circumstances, the image forming system may undesirably attempt to form part of an image at one or more hole locations. In such an event, imaging materials such as ink or toner are not deposited on or transferred to the print media, and remain as residual materials in the imaging assembly of the image forming system. The residual materials can then adversely affect the reliability and output quality of the image forming systems.

DESCRIPTION

Figure 1:
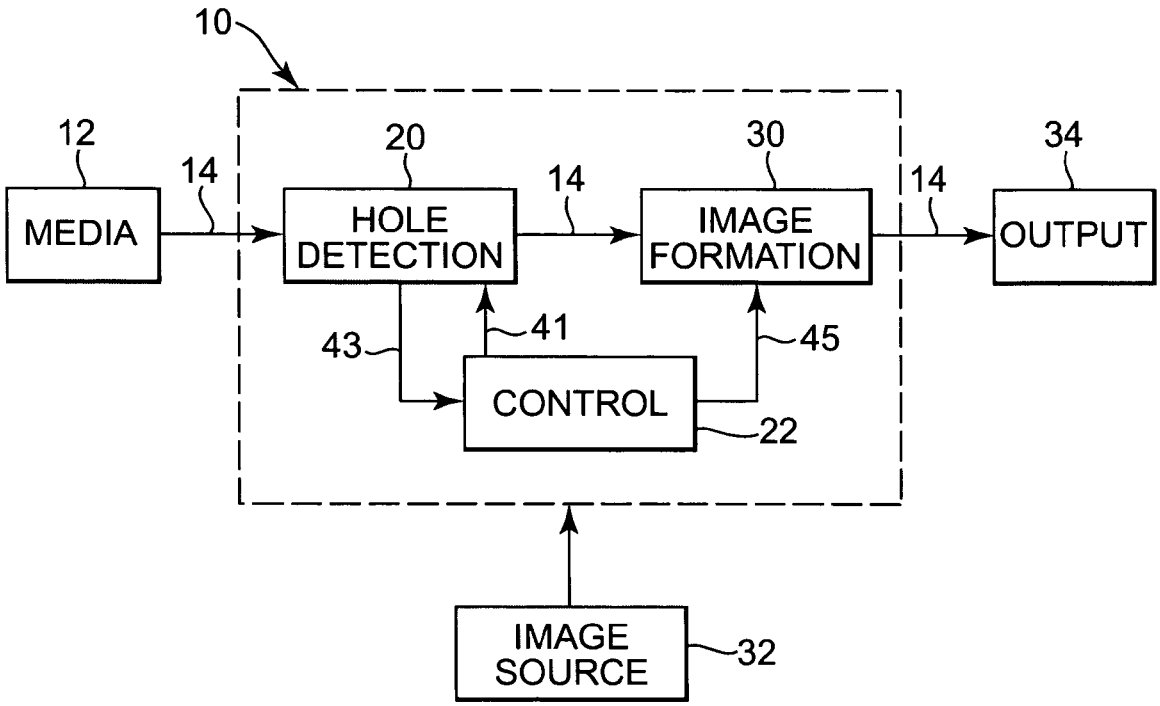
FIG. 1 is a schematic illustration of one embodiment of an image forming system employing an embodiment of an apparatus and method for detecting holes in print media in accordance with one embodiment of the present disclosure.

Referring to FIG. 1, one embodiment of an image forming system 10 for forming images on media, such as print media 12, is schematically illustrated. Image forming system 10 includes a media feed path 14 which extends through image forming system 10, and is adapted to transport print media 12 through different portions of image forming system 10. Image forming system 10 can be any image forming system, including but not limited to electrophotographic systems and inkjet systems. Image forming system 10 may be implemented as a laser printer, inkjet printer, copier, facsimile, and the like.

Print media 12 is transported via media feed path 14 to a hole detection unit 20. As described in greater detail below, hole detection unit 20, in operable communication with a control unit 22 via communication links 41, 43, scans print media 12 to identify holes in print media 12. After print media 12 is scanned by hole detection unit 20 and holes in the print media 12 are identified, print media 12 is transported to an image formation unit 30 to receive an image thereon. Using information from hole detection unit 20, control unit 22 controls image formation unit 30 via communication link 45 so that an image is not formed at an identified hole location. Further, control unit 22 may operate to determine that the proper type of print media 12 is present before directing image formation unit 30 to transfer an image to print media 12. For example, if print media 12 having preformed holes is anticipated, control unit 22 can stop the imaging process if no holes are identified. Similarly, if print media 12 without holes is anticipated, control unit 22 can stop the imaging process if print media 12 having holes is identified. As illustrated, the image is provided to image forming system 10 by an image source 32 which may be, for example, a computer, a memory card, a video input, or the like. After an image is formed on print media 12, print media 12 is transported to an output location 34.

Figure 4:
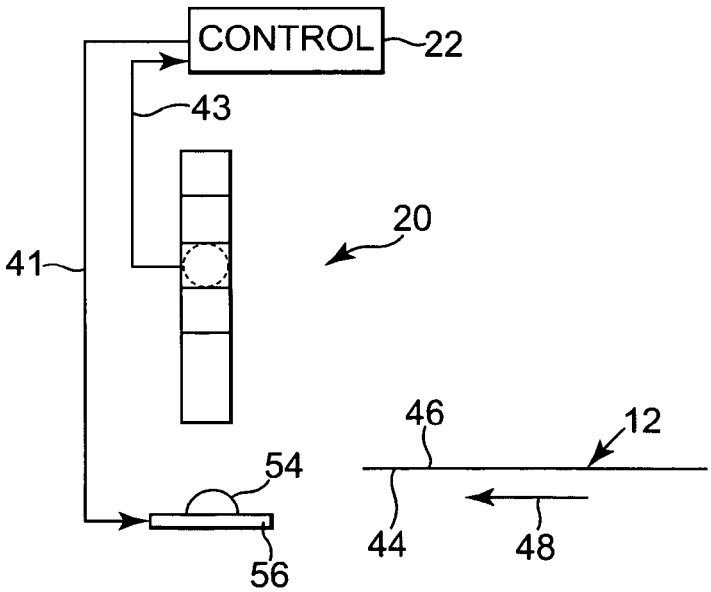
FIG. 4 illustrates another side view of the embodiment of the apparatus for detecting holes in print media, taken along line 4-4 of FIG. 2 in accordance with one embodiment of the present disclosure.
Figure 2:
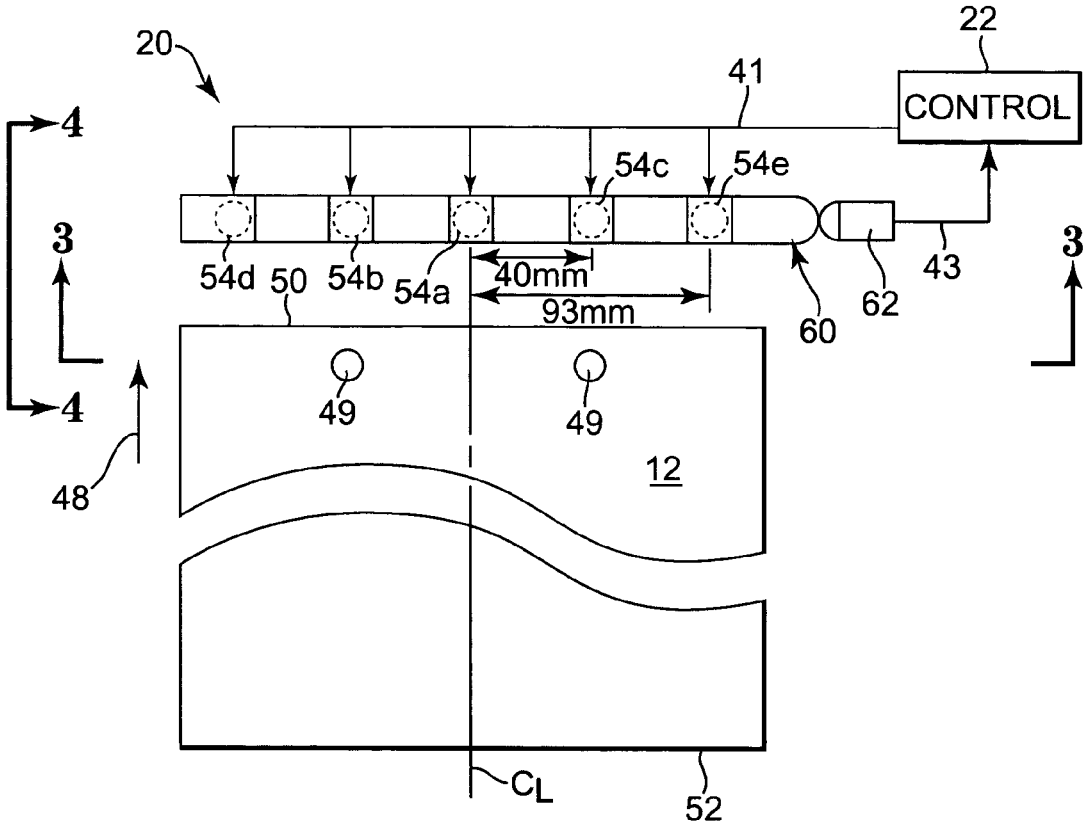
FIG. 2 illustrates a top view of one embodiment of an apparatus for detecting holes in print media in accordance with one embodiment of the present disclosure.
Figure 3:
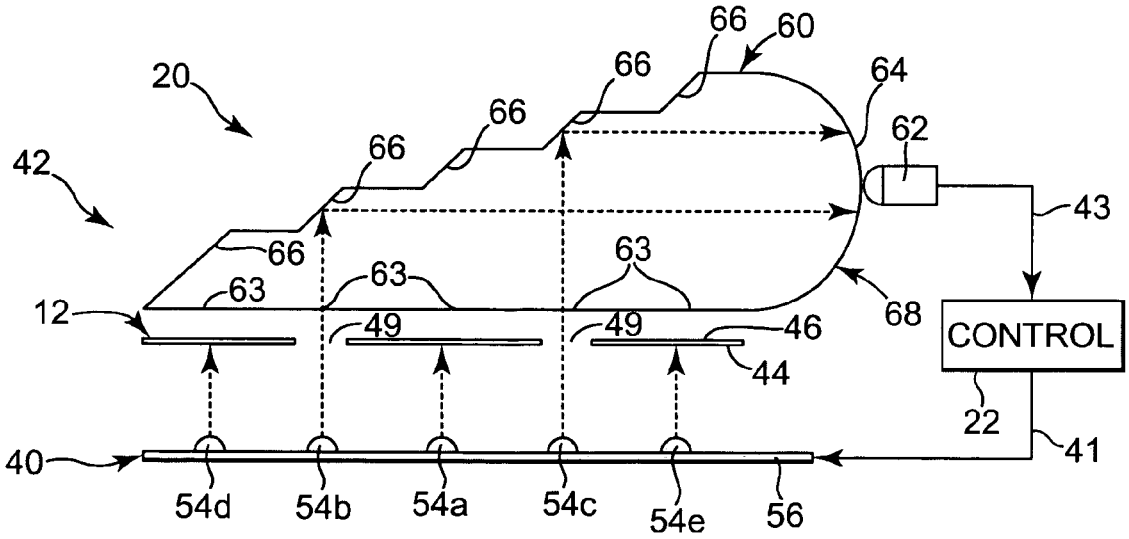
FIG. 3 illustrates a side view of the embodiment of the apparatus for detecting holes in print media, taken along line 3-3 of FIG. 2 in accordance with one embodiment of the present disclosure.

One embodiment of hole detection unit 20 is shown in greater detail in FIGS. 2-4. Hole detection unit 20 includes an illumination unit 40 and a receiving unit 42. Illumination unit 40 and receiving unit 42 are in operable communication with control unit 22 via communication links 41, 43, respectively. Illumination unit 40 and receiving unit 42 are positioned along print media feed path 14 such that illumination unit 40 is on a first side 44 of print media 12, and receiving unit 42 is on a second side 46 of print media 12, opposite first side 44. Illumination unit 40 and receiving unit 42 are further positioned, in this embodiment, such that they extend across the width of print media 12 in a direction transverse to the direction of travel of print media 12 (illustrated by arrow 48 in FIG. 2 and FIG. 4). Accordingly, as print media 12 is moved along media feed path 14 between illumination unit 40 and receiving unit 42, the width of print media 12 is scanned for holes 49 (illustrated in this exemplary embodiment along a top edge of print media 12), from a leading edge 50 of print media 12 to a trailing edge 52 of print media 12.

In one embodiment, illumination unit 40 includes a plurality of light emitting devices 54 positioned adjacent the first side 44 of print media 12 such that light emitting devices 54 emit light towards the first side 44 of print media 12. Each light emitting device 54 illuminates a portion of the width of print media 12. The light emitting devices 54 may be any type of suitable light emitting device, and may include light emitting diodes (LEDs) or incandescent light sources, depending upon the particular application. The light emitting devices 54 may emit in the, non-visible light spectrum, such as infrared, or the visible light spectrums. In one embodiment, the illumination unit 40 includes a plurality of light emitting diodes (LEDs) mounted on a printed circuit board 56.

The receiving unit 42 includes a light guide 60 (sometimes referred to as a light pipe in some embodiments) and a light sensing device 62. Light guide 60 is positioned adjacent second side 46 of print media 12, and is configured to receive light emitted by illumination unit 40. In one embodiment, light guide 60 includes an input location 63 for light from each of the plurality of light emitting devices 54 of illumination unit 40. The light guide 60 directs the received light from input locations 63 to an output location 64 of the light guide 60, where light sensing device 62 is located. Light sensing device 62 is sensitive or responsive to light of the type emitted by the light emitting devices 54, and may be any suitable type of photoreceptor or photocell. When light exiting output 64 of light guide 60 reaches light sensing device 62, light sensing device 62 produces a sense signal indicative of light reaching the light sensing device 62. The sense signal is received by control unit 22 via communication link 43.

In the embodiment illustrated in FIGS. 24, the light guide 60 is a monolithic element that gathers light from multiple input locations 63 across the width of print media 12 and blends the gathered light into a single light signal at output location 64. In the illustrated embodiment, light guide 60 is formed of a molded or machined transparent glass or polymer material. Light guide 60 includes a plurality of internally reflective surfaces 66 (best seen in FIG. 3), with an internally reflective surface 66 for each of the input locations 63. The internally reflective surfaces 66 direct light from the light emitting devices 54 toward the output location 64 of the light guide 60. The light guide 60 is further provided with a suitably shaped end 68 (e.g., parabolic in one embodiment) adjacent the output location 64 to focus or direct light to the light sensing device 62.

In the embodiment of FIGS. 2-4, internally reflective surfaces 66 are illustrated as 45° stepped portions. However, the illustrated embodiment is exemplary, and in view of this description, other suitable shapes and configurations of light guide 60 will be recognized by those skilled in the art. In other embodiments, light guide 60 may comprise a plurality of light pipes, such as optical fibers, that gather light from multiple locations across the width of print media 12, and then direct the gathered light to a single output location at light sensing device 62. The plurality of light pipes may be integrated into a single unit, as by over-molding the light pipes within a housing.

The number, spacing and positioning of light emitting devices 54 of illumination unit 40 and input locations 63 of light guide 60 are selected, at least in part, based upon the width of the print media 12, likely locations for holes 49 (for print media 12 having preformed holes), and the desired accuracy in identifying the location of a detected hole. The number of light emitting devices 54 and input locations 63 may be increased to provide greater accuracy when determining the location of any holes 49 in the print media 12, or the number may be decreased if less accuracy is desired. Similarly, the spacing between adjacent light emitting devices 54 and input locations 63 may be decreased to provide greater accuracy, or the spacing may be increased if less accuracy is. In one embodiment, light emitting devices 54 and input locations 63 are positioned in columns where holes 49 are likely to be encountered in the print media 12. A "column" refers to the area illuminated by an individual light emitting device 54 as the print media 12 moves past the illumination unit 40. The columns may cover the width of the print media 12, or may cover less than the width of the print media 12.

The locations for preformed holes in standard-sized print media are generally standardized. For example, in the three-hole fling system widely used with 8½ inch by 11 inch (i.e., 216 mm by 279 mm) "letter" sized print media in the United States, holes in the print media are typically spaced approximately 108 mm apart (center to center), and are located from the nearest edge of the print media in the range of 10 mm to 15 mm (edge to center). The holes are typically located symmetrically in relation to the print media. The International Organization for Standardization, in ISO 838, specifies that for filing purposes, two holes of 6±0.5 mm diameter can be punched into the print media. The centers of the two holes are 80±0.5 mm apart and have a distance of 12±1 mm to the nearest edge of the print media. The holes are located symmetrically in relation to the axis of the print media.

Using current ISO standards and generally accepted hole positioning in other systems (e.g., the three-hole 108 mm filing system used in the United States), the approximate locations of preformed holes in the print media 12 can be anticipated. By positioned light emitting devices 54 to cover columns encompassing the anticipated hole locations, most print media 12 having preformed holes can be identified, regardless of the orientation of the print media 12 as it is passed through the imaging system 10.

In the illustrated embodiment, five light emitting devices 54*a*-54*e* are positioned at the centerline $C_L$ of print media feed path 14, and locations approximately 40 mm and 93 mm on both sides of the centerline of the print media feed path 14. The light emitting device 54*a* positioned on the centerline $C_L$ will detect a center hole of print media having a three-hole punch along its leading or trailing edges 50, 52, because the hole pattern for print media having a three-hole punch is symmetrically located with respect to the centerline $C_L$ of print media 12. The light emitting devices 54*b* and 54*c* positioned approximately 40 mm on either side of the centerline $C_L$ will detect the holes of print media having the ISO standard 80 mm hole spacing along its leading or trailing edges 50, 52. The light emitting devices 54*d* and 54*e* positioned approximately 93 mm on either side of the centerline will be positioned within 12-15 mm of the lateral edges of the print media, and will detect the holes of print media having preformed holes on the lateral edges that conform to generally accepted edge spacing in either ISO or other systems.

Figure 5:
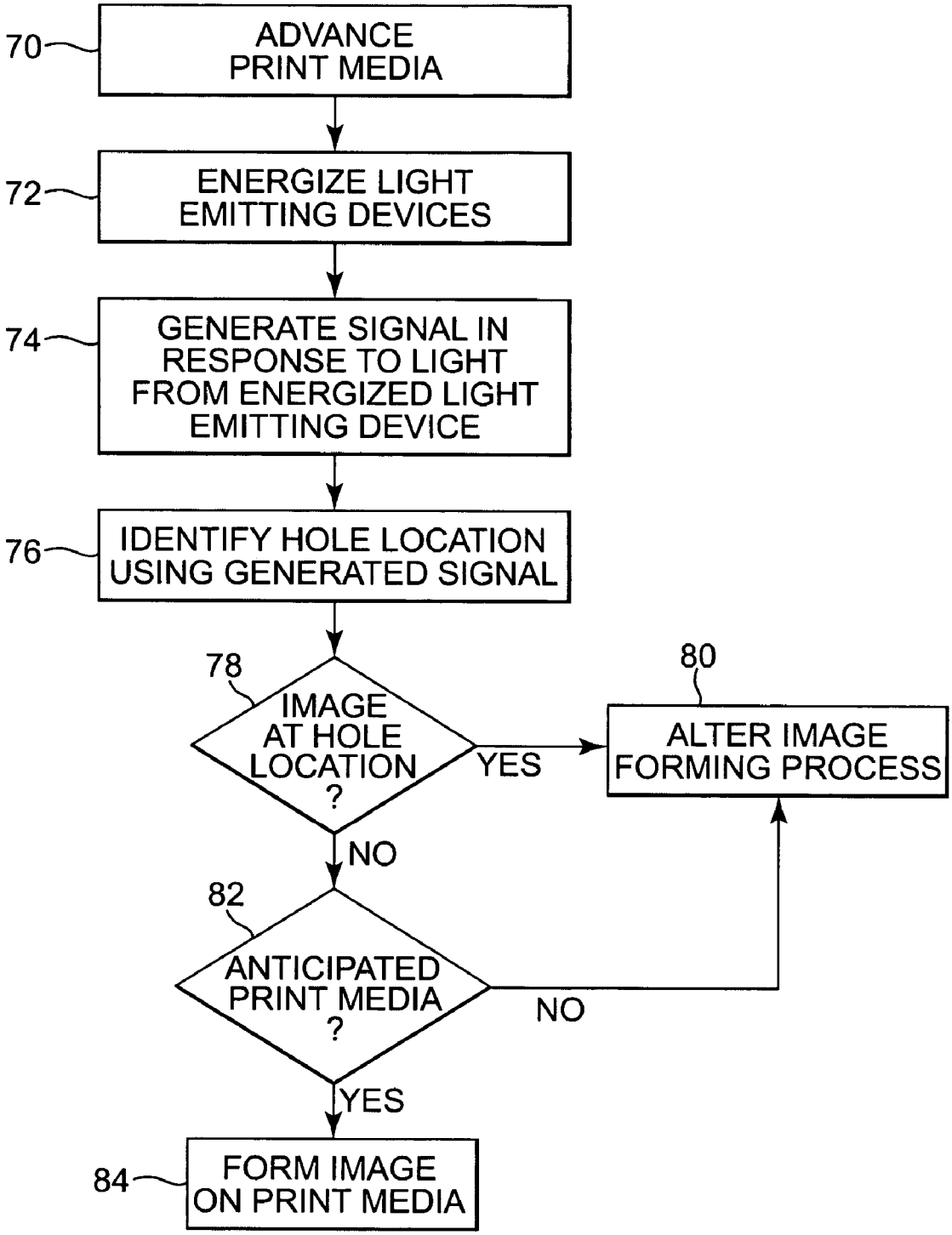
FIG. 5 is a flow chart illustrating one implementation of an embodiment of a method for detecting holes in print media in accordance with one embodiment of the present disclosure.

In one embodiment of use, with reference to FIG. 5, the print media 12 is advanced between the light emitting devices 54 of the illumination unit 40 and the light guide 60 of the receiving unit 42 (step 70), and control unit 22 selectively energizes the plurality of light emitting devices 54 (step 72).

As best seen in FIG. 3, if there are one or more holes 49 in the print media 12, light from the light emitting devices 54 nearest the holes 49 passes through the holes 49, while light from other light emitting devices 54 is at least substantially blocked by the print media 12. After passing through the holes 49, the light enters the light guide 60 at corresponding input locations 63 and is directed through the light guide 60 to the output location 64, where the light is sensed by light sensing device 64 and a sense signal indicative of a hole in print media 12 is generated (step 74). If no holes are present in the print media 12, no light, or substantially no light, reaches the light sensing device 62, and a signal indicative of a hole in the print media 12 is not generated.

The control unit 22 receives the sense signals generated by the hole detection unit 20, identifies the corresponding hole locations using the sense signals (step 76) if sense signals are received, and determines if the image to be formed by the image formation unit 30 is located at a detected hole location (step 78). If so, control unit 22 alters the image forming process (step 80) so that formation of an image at a hole location does not occur. The control unit 22 may alter the image forming process in any number of ways. In one embodiment, the image forming process may be halted entirely. In another embodiment, the control unit 22 may modify or alter the location of the image on the print media 12, or the size of the image may be changed. In one embodiment, the control unit 22 may signal the user if print media different than that anticipated is detected.

If the image to be formed by the image formation unit 30 is not located at a detected hole location, then the control unit determines if the print media 12 is the anticipated print media (step 82). If the print media 12 is not the anticipated print media, the control unit 22 alters the image forming process (step 80), as described above. If the print media 12 is the anticipated print media, then the image is formed on the print media (step 84). For example, if print media 12 having preformed holes is anticipated, control unit 22 can alter the imaging process if no holes are detected in the print media. Similarly, if print media 12 without holes is anticipated, control unit 22 can alter the imaging process if holes are detected in the print media.

In step 72 of FIG. 5, the light emitting devices 54 of the illumination unit 40 may be energized simultaneously, individually, or in groups of two or more, depending upon the desired hole sensing resolution. When all of the light emitting devices 54 are illuminated simultaneously, the sense signal generated by the light sensing device 62 is indicative of a hole in the print media 12 somewhere across the width of the portion of the print media 12 that is adjacent the illumination unit 40. However, the sense signal contains no information regarding exactly where the hole is located across the width of the print media 12. By energizing the light emitting devices 54 of the illumination unit 40 individually, such as in a sequential manner from one lateral edge of the print media 12 to the opposite lateral edge of the print media 12, the control unit 22 can identify the particular light emitting device 54 responsible for the sense signal, thereby precisely locating the position of the hole in the print media 12. Thus, by selectively and individually energizing the light emitting devices 54, one light guide 60 can be used to detect holes in different locations of the print media 12.

In one implementation, useful with less expensive light sensing devices 62 that are slower to respond to the presence of light (and therefore less sensitive to quickly strobed light emitting devices 54), all of the light emitting devices 54 are simultaneously energized as the print media 12 passes the illumination unit 40. All of the light emitting devices 54 remain energized until light is sensed by light sensing device 62. The first light sensed by light sensing device 62 provides leading edge information of the presence of a hole (and thus hole position information with respect to the direction of the movement of print media 12. Control unit 22 logs this hole position information, and then sequentially energizes light emitting devices 54 at a speed matched to the response time of the light sensing device 62 to identify the particular light emitting device or devices 54 responsible, and therefore provide hole position information with respect to a direction perpendicular to the movement of print media 12. In this manner, inexpensive slow response components are combined to produce accurate hole placement information, while maintaining high print media throughput speed. In other embodiments, a particular hole location can be identified using light emitting devices 54 that emit at different brightness levels or wavelengths, where the light sensing device 62 is sensitive to variations in brightness or wavelength.

The embodiments described herein are useful with any type of image forming system, including but not limited to electrophotographic image forming systems and inkjet image forming systems, including laser printers, inkjet printers, copiers, facsimiles, and the like. Further, the disclosed embodiments are useful with systems other than image forming systems in which a sheet media is transported along a conveyance path and in which the detection of holes in the sheet media is desirable or useful.

Although exemplary embodiments have been illustrated and described herein for purposes of description, it will be appreciated by those of ordinary skill in the art that a wide variety of alternate and/or equivalent implementations may be substituted for the specific embodiments shown and described without departing from the spirit and scope of the present disclosure. This application is intended to cover any adaptations or variations of the embodiments discussed herein. Therefore, it is manifestly intended that the foregoing discussion is illustrative, and the claimed subject matter is limited and defined by the following claims and the equivalents thereof.

What is claimed is:

1. An apparatus comprising:

a plurality of independently operable light emitting devices;

a light guide positioned to allow media to move between the light guide and the plurality of light emitting devices and configured to guide light from the plurality of light emitting devices;

a single light sensing device positioned to receive the light from the plurality of light emitting devices guided by the light guide and to generate a signal indicative of the light, wherein the single light sensing device comprises a single photocell or photoreceptor; and a control unit configured to receive the signal generated by the single light sensing device, wherein the control unit is configured to simultaneously energize the plurality of light emitting devices to detect a presence of a hole in the media, and after detecting the presence of the hole in the media, sequentially energize individual ones of the plurality of light emitting devices to detect a location of the hole in the media.

2. The apparatus of claim 1, wherein the plurality of light emitting devices emit light toward a first side of the media, and wherein the light guide receives light transmitted through holes in the media on a second side of the media.

3. The apparatus of claim 1, wherein the light guide directs light from a plurality of input locations to a single output location.

4. The apparatus of claim 1, wherein the plurality of light emitting devices emit light in the infrared spectrum.

5. The apparatus of claim 1, wherein the plurality of light emitting devices emit light in the visible spectrum.

6. A method comprising:

receiving light passed through a hole in media into a light guide, with the media positioned between a plurality of independently operable light emitting devices and the light guide;

directing the light from the plurality of light emitting devices in the light guide to a single light sensing device, wherein the single light sensing device comprises a single photocell or photoreceptor; and generating a signal indicative of the hole in the media using the light reaching the light sensing device, wherein receiving the light passed through the hole in the media includes simultaneously energizing the plurality of light emitting devices to detect a presence of the hole in the media, and after detecting the presence of the hole in the media, sequentially energizing individual ones of the plurality of light emitting devices to detect a location of the hole in the media.

7. The method of claim 6, further comprising advancing the media between the plurality of light emitting devices and the light guide.

8. The method of claim 7, further comprising energizing the plurality of light emitting devices as the media advances between the light emitting devices and the light guide.

9. The method of claim 6, further comprising preventing the formation of an image at the location of the hole in the media.

10. The method of claim 6, further comprising determining if the media is an anticipated media.

11. The method of claim 10, further comprising altering an image forming process if the media is not the anticipated media.

12. An image forming system comprising:

a hole detection apparatus comprising a plurality of independently operable light emitting devices, a light guide positioned to allow media to move between the light guide and the plurality of light emitting devices and configured to guide light from the plurality of light emitting devices, and a single light sensing device positioned to receive the light from the plurality of light emitting devices guided by the light guide and to generate a signal indicative of the light, wherein the single light sensing device comprises a single photocell or photoreceptor;

an imaging unit for forming an image on the media; and a control unit in communication with the hole detection apparatus and the imaging unit, the control unit for receiving the signal generated by the hole detection apparatus and for preventing the formation of the image at a location of a hole in the media, wherein the control unit simultaneously energizes the plurality of light emitting devices to detect a presence of a hole in the media, and after detecting the presence of the hole in the media, sequentially energizes individual ones of the plurality of light emitting devices to detect a location of the hole in the media.

13. The image forming system of claim 12, wherein the light guide comprises a monolithic element having an input location for each of the plurality of light emitting devices, and a single output location.

14. The image forming system of claim 12, wherein the plurality of light emitting devices and the light guide are positioned across a width of the media transverse to a direction of movement of the media.

15. A computer-readable storage medium having computer-readable instructions for causing an image forming system to perform a method for de holes in print media in an image forming system, the method comprising:

receiving light passed through a hole in media into a light guide, with the media positioned between a plurality of independently operable light emitting devices and the light guide;

directing the light from the plurality of light emitting devices in the light guide to a single light sensing device; and generating a signal indicative of the hole in the media using the light reaching the light sensing devices, wherein receiving the light passed through the hole in the media includes simultaneously energizing the plurality of light emitting devices to detect a presence of the hole in the media, and after detecting the presence of the hole in the media, sequentially energizing individual ones of the plurality of light emitting devices to detect a location of the hole in the media.

16. The computer-readable storage medium having computer-readable instructions of claim 15, wherein the method further comprises advancing the media between the plurality of light emitting devices and the light guide.

17. The computer-readable storage medium having computer-readable instructions of claim 16, wherein the method further comprises energizing the plurality of light emitting devices as the media advances between the light emitting devices and the light guide.

18. The computer-readable storage medium having computer-readable instructions of claim 15, wherein the method further comprises altering an image forming process if the media is not an anticipated media.

* * * * *

UNITED STATES PATENT AND TRADEMARK OFFICE

CERTIFICATE OF CORRECTION

PATENT NO. : 7,411,603 B2
APPLICATION NO. : 11/092321
DATED : August 12, 2008
INVENTOR(S) : David A. Rehmann It is certified that error appears in the above-identified patent and that said Letters Patent is hereby corrected as shown below:

In column 2, line 56, delete "FIGS. 24" and insert -- FIGS. 2-4 --, therefor.

In column 7, line 21, in Claim 15, delete "de" and insert -- detecting --, therefor.

In column 8, line 5, in Claim 15, delete "devices," and insert -- device, --, therefor.

Signed and Sealed this

Eighteenth Day of November, 2008

JON W. DUDAS
*Director of the United States Patent and Trademark Office*